US007478724B2

(12) United States Patent
Vor Keller

(10) Patent No.: US 7,478,724 B2
(45) Date of Patent: Jan. 20, 2009

(54) FIREARM HOUSING WITH HEAVY-DUTY LOCKING MECHANISM

(76) Inventor: Albert W. Vor Keller, 2418 Ashton Woods Ct., Marietta, GA (US) 30068

( * ) Notice: Subject to any disclaimer, the term of this patent is extended or adjusted under 35 U.S.C. 154(b) by 297 days.

(21) Appl. No.: 11/432,117

(22) Filed: May 11, 2006

(65) Prior Publication Data

US 2007/0051026 A1 Mar. 8, 2007

Related U.S. Application Data

(60) Provisional application No. 60/679,900, filed on May 11, 2005.

(51) Int. Cl.
*B65D 85/00* (2006.01)

(52) U.S. Cl. ..... 206/317; 211/64; 224/911; 42/70.11

(58) Field of Classification Search ..... 42/70.11; 70/446, 449; 206/317; 224/911–913; 211/64
See application file for complete search history.

(56) References Cited

U.S. PATENT DOCUMENTS

| | | | | |
|---|---|---|---|---|
| 1,173,376 A | | 2/1916 | Noye | |
| 1,951,418 A | * | 3/1934 | Jacobi | 70/360 |
| 2,551,913 A | | 5/1951 | Toby | |
| 3,558,090 A | | 1/1971 | Bird | |
| 4,303,158 A | * | 12/1981 | Perkins | 206/373 |
| 4,747,280 A | | 5/1988 | Shaw | |
| 4,768,021 A | | 8/1988 | Ferraro | |
| 4,858,799 A | | 8/1989 | Young | |
| 4,858,800 A | | 8/1989 | Holtzclar, Jr. et al. | |

(Continued)

FOREIGN PATENT DOCUMENTS

WO WO/00/65292 11/2000

(Continued)

OTHER PUBLICATIONS

DERMALOG.DE/BRITAIN/PRODUCTS/KEY/KEY.HTM, DERMALOG KEY, The Ultimate in Security, DERMALOG KEY-The Safest And Easiest Way of Access Control, 3 pages, printed from the internet , Jul. 18, 1998.

(Continued)

*Primary Examiner*—Michael Carone
*Assistant Examiner*—Samir Abdosh
(74) *Attorney, Agent, or Firm*—Gardner Groff Greenwald & Villanueva, PC

(57) ABSTRACT

A safety housing for a firearm includes a biometric or other access authentication device, an enclosure, a frame assembly, a slide assembly, and a door. The frame and the slide assemblies nest within the enclosure, the frame assembly affixes to the enclosure, and the slide assembly moves relative to the frame assembly. The door moves between an open position in which the firearm is removable through an access opening in the housing, and a closed position covering the access opening. The housing has cooperating internal components that operate to lock the door closed when the slide assembly is locked in place, to unlock the door when the slide assembly is released, to move the door open when the slide assembly is moved upwards, and to move the door closed when the slide assembly is moved downwards. Also, the frame assembly has adjustably positionable support elements for different firearms.

18 Claims, 14 Drawing Sheets

U.S. PATENT DOCUMENTS

| | | | | |
|---|---|---|---|---|
| 4,912,867 | A | 4/1990 | Dukes, Jr. | |
| 5,236,086 | A | 8/1993 | MacTaggart | |
| 5,275,317 | A * | 1/1994 | Rogers et al. | 224/244 |
| 5,439,150 | A * | 8/1995 | Trahms | 224/404 |
| 5,449,103 | A | 9/1995 | Tilley | |
| 5,513,785 | A | 5/1996 | Campagna, Jr. | |
| 5,518,155 | A | 5/1996 | Gallagher | |
| 5,546,690 | A | 8/1996 | Cilluffo | |
| 5,603,179 | A | 2/1997 | Adams | |
| 5,636,464 | A | 6/1997 | Ciluffo | |
| 5,701,770 | A | 12/1997 | Cook et al. | |
| 5,810,221 | A | 9/1998 | Beletsky et al. | |
| 5,828,301 | A | 10/1998 | Sanchez | |
| 5,855,305 | A | 1/1999 | Nichols | |
| 5,857,757 | A * | 1/1999 | Bieker et al. | 312/351.3 |
| 5,913,666 | A * | 6/1999 | Perkins | 42/70.11 |
| 5,916,087 | A | 6/1999 | Owens | |
| 5,944,239 | A | 8/1999 | Rogers et al. | |
| 5,961,013 | A | 10/1999 | Colllins | |
| 6,230,946 | B1 * | 5/2001 | Vor Keller et al. | 224/244 |
| 6,260,300 | B1 * | 7/2001 | Klebes et al. | 42/70.11 |
| 6,301,815 | B1 | 10/2001 | Sliwa | |
| 6,320,975 | B1 | 11/2001 | Vieweg | |
| 6,405,861 | B1 * | 6/2002 | Siler et al. | 206/317 |
| 6,421,943 | B1 | 7/2002 | Caulfield et al. | |
| 6,523,374 | B1 | 2/2003 | Owens | |
| 6,563,940 | B2 | 5/2003 | Recce | |
| 6,570,501 | B2 * | 5/2003 | Bushnell et al. | 340/542 |
| 6,641,009 | B2 | 11/2003 | French et al. | |
| 6,843,081 | B1 * | 1/2005 | Painter | 70/63 |
| 7,055,724 | B2 * | 6/2006 | Farentinos | 224/404 |
| 7,159,711 | B1 * | 1/2007 | Gardner | 206/317 |
| 2001/0019071 | A1 | 9/2001 | Vor Keller et al. | |
| 2003/0159954 | A1 * | 8/2003 | Russell | 206/317 |
| 2006/0065560 | A1 * | 3/2006 | Dickinson et al. | 206/317 |
| 2008/0047860 | A1 * | 2/2008 | Shane | 206/317 |

FOREIGN PATENT DOCUMENTS

| | | |
|---|---|---|
| WO | WO/00/65528 | 11/2000 |

OTHER PUBLICATIONS

EETIMES.COM/STORY/TECHNOLOGY/APPLIED/, Applied Technology, Self-Contained Fingerprint ID Systems Expand Security Options, 3 pages, printed from the internet, Sep. 17, 1999.

FUJITSU.COM.JP/HYPERTEXT/NEWS/1998/AUG/19-E, Fujitsu Introduces FingerPass Card, a PC Card-Based Fingerprint Recognition Device for Mobile PC's, 2 pages, printed from the internet, Aug. 19, 1998.

VALUEMEDIA.COM/VALLUE/OLDPAGES/, Keytronics, Secure Finger Print Scan, 1 page, printed from the internet, Sep. 17, 1999.

HSDH.COM/INDEX2/, HSDH Systems, Hand Gun Safety Devices, 7 pages, printed from the internet, Mar. 2000.

CC.GATECH.EDU/FCE/ARCHIVES/FUTURE/, Georgia Tech, New Chip Verifies Fingerprints, 4 pages, printed from the internet, May 22, 1997.

MBIRD.NE.JP/MELSYS/EG/SURVEILLANCE/FINGERPRINT/FINGRE03/, Mitsubishi—Compact Fingerprint Checker, 2 pages, printed from the internet, Sep. 1999.

Authentiec, Inc., Personal Security for the Real World, 7 pages, Sep. 1999.

PRECISEBIOMETRICS.COM/MAIN/, Precise Biometrics, Security is Convenience, 5 pages, printed from the internet, Sep. 1999.

EET.COM/NEWS/97/975NEWS/PROCESSOR/, EET. Com, Processor Enables Print ID on a Card, 4 pages, printed from the internet, 1999.

QUICKLOCKGUNLOCK.COM/, Is Your Child Safe From Your Weapons?, 4 pages, printed from the internet, Nov. 1999.

COLT.COM/COLT/HTML/KL_POSITIONPAPER/, Colt's position on Personalized Weapons Technology, 8 pages, printed from the internet, Nov. 10, 1998.

GUNINDEX.COM/SAF/, Standard Listings, 2 pages, printed from the internet, 1998.

GUNLOCKER.COM/, The Gunlocker, 1 page, printed from the internet, Nov. 1999.

CNN.COM/TECH/COMPUTING/9909/PENTAGON.SMART.CARD.IDG/INDEX/, Pentagon Gets 'smart' by Ellen Messar, 3 pages, printed from the internet, Sep. 21, 1999.

BRIGADEGUNLEATHER.COM/LAW-ENFORCEMENT/, Brigade GunLeather, Law Enforcement Holsters, 2 pages, printed from the internet, Nov. 1999.

ARMEDILLOGUNLOCK.COM/, The Armedillo 9000 Series Trigger A Debate, By Paul M. Barrett, 2 pages, printed from the internet, Jan. 27, 2000.

APBNEWS.COM/CJPROFESSIONALS/BEHINDTHEBADGE/1998/11/17/SMARTGUNS_01./, "Smart" Guns on the Way by J.T. Brady, 4 pages, printed from the internet, Nov. 17, 1998.

BORLOC.COM/, The Firearms Safety Lock That Really Works, 4 pages, printed from the internet, Nov. 1999.

SAFERGUNSNOW.ORG/SAFETY_TECHNOLOGIES_ SUMMARY/,SaferGunsNow.org, Summary of Technologies of Childproof Handguns, Smart Guns, Safer Guns, Personalized Guns and High-tech Trigger Locks. Feb. 10, 2000 9 pages, article from the internet.

SECURERITE.COM/PRODUCTS/SAFE_TRIGGER.ASP/, Gun Trigger Lock, 1 page, printed from the internet, Nov. 1999.

SHOTLOCK.COM/1000/, 1000 Series Trigger Lock, 2 pages, printed from the internet, Nov. 1999.

SMARTLOCK.COM/PRODUCT/, Smart Lock Technology, Inc., Introducing Magloc Safety Conversion For Firearms, 2 pages, printed from teh internet, Feb. 2000.

SMITH-WESSON.COM/, Smith & Wesson, Online Catalog Shopping, 3 pages, printed from the internet, Oct. 1999.

TACTILEGUNLOCK.COM/, IRG Intellectual Resources Group, Inc., We have a unique gunlock that stops accidental discharge and unauthorized use, 10 pages, printed from the internet, Nov. 1999.

TARNHELM.COM/, Tarnhelm Supply Company, Inc., Magna-Trigger Gun Safety, 5 pages, printed from the internet, Nov. 1999.

TVSMARKETING.COM/, Speed Release Gun Lock, 3 pages printed from the internet, Nov. 1999.

SMITH-WESSON.COM/MISC/LETTER_TO_BOSTOM/. Smith & Wesson, An Open Letter to the Citizens of Boston, 4 pages, printed from the internet, Feb. 2000.

CHAMBERSAFE.COM/HOME.CFM/, When It Comes to Firearm Safety Almost is Not Enough, 4 pages, printed from the internet, Nov. 1999.

USERS.IDS.NET/_MIKEDIN/IDEA/FPRINTS/, Ideamation, Inc., Fingerprint Identification/Identify Verification Systems, 4 pages, printed from the internet, Sep. 1999.

STARTIN.CO.IL/, Starten Technologeis Ltd, V-Card Biometrics Security Based Systems, 3 pages, printed from the internet, Sep. 1999.

ADV-BIO.NET/, Advanced Biometrics, Inc., The LiveGrip Access System is a Closed, Passive, Transparent Identification and Access System, 2 pages, printed from the internet, 1998.

SECUGEN.COM/PRODUCTLIST/, Secugen, Secugen Corporation Product List, 2 pages, printed from the internet, 1999.

SHOPPER.COM/IDX/INPUT_DEVICES/SCANNERS_BARCODE_READ.../OTHER/, SHOPPER.COM, Input Devices, 3 pages, printed from the internet, Sep. 1999.

SAFE-GUARD-CORP.COM/, Protective Tecnologeis, Inc., Protek 5 pages, printed from the internet, Sep. 1999.

WORLD.SONY.COM/ELECTRONICS/COMPONENTS/PRODUCTS/PRODUCT57./, Sony on Line, Fingerprint Identification Unit, 4 pages, printed from the internet, Sep. 1999.

SECRETARY.ERC.CALTECH.EDU/PSALTIS/RESEARCH.PU/FINGERPRINT/, Psaltis Group, Title: Optical Fingerprint Recognition, 3 pages, printed from the internet, Sep. 1999.

EETIMES.COM/PRINTABLEARTICLE?DEC_/, EETIMES Online, Phillips, WhoVision Ally on Fingerprint Sensors, 2 pages, printed from the internet, Oct. 20, 1998.

Smith, Kerby C., "Who Needs a Smart Gun . . . Here's a Smart Holster! Michael's of Oregon Unveils its Pro4 ID Holster with a System that is as Secure as a Vault on the Officer's Belt," Handguns, 1page, Mar. 2001.

Metcalf, Dick, "A High-Tech Holster for the 21st Century! Uncle Mike's Pro 4 ID", Shooting Times, 1 page, Mar. 2001.

UNCLEMIKES.COM/M HOLSTERS/, / Michael's of Oregon Co., "Triple Retention Duty Holster with a Patented Internal Lock", 1 page, printed from the inernet, no date.

123GUNSAFETY.COM/, Smart Biometrics, Inc., "123 Gun Safety Imagine a Gun Safe that Works with the Touch of a Finger", 1 page, no date.

SMARTBIOMETRICS.COM/PAGES/BIOVAULT/, Smart Biometrics, Inc., "Bio-Vault", 2 pages, no date.

ACCIMETRIX.COM/PRODUCTS/SECURITYPRODUCTS/, Accimetrix Products and Services, Security Products, 3, pages, no date.

The Smart Holster, American Handgunner, 1 page, Mar. 2001.

Office Action for U.S. Appl. No. 09/826,111 Date of Mailing Oct. 10, 2002, 9 pages.

Office Action for U.S. Appl. No. 09/903,286, Date of Mailing Dec. 3, 2002, 7 pages.

Office Action for U.S. Appl. No. 10/115,627, Date of Mailing Mar. 30, 2004, 6 pages.

Office Action for U.S. Appl. No. 10/115,627, Date of Mailing Dec. 23, 2003, 5 pages.

Office Action for U.S. Appl. No. 10/115,627, Date of Mailing Nov. 1, 2004, 5 pages.

PRWEB.COM/RELEASES/1998/PRWEB6485/, PRWEB.COM, Forget Passwords! Protect Your Computer With Your Fingerprint, 3 pates, printed from the internet, 1997.

PRINTRACKINTERNATIONAL.COM/PRO52797/, Press Release, Printrak to Team with Siemens Dixdorf to Provide Biometric Identification Solutions, 2 pages, printed from the internet, Sep. 1999.

BERFETTAUSA.COM/SMARTGUN/, Baretta Announces Position Concerning "Smart Gun" Technology, 1 page, printed from the internet, Jan. 13, 2000.

Dow Jones, The Wall Street Journal, "Smart Guns" Trigger a Debate, By Paul M. Barrett, 3 pages, Jan. 27, 2000/.

* cited by examiner

DETAIL A

DETAIL B

DETAIL C

FIREARM HOUSING WITH HEAVY-DUTY LOCKING MECHANISM

CROSS-REFERENCE TO RELATED APPLICATION

This application claims the priority benefit of U.S. Provisional Patent Application Ser. No. 60/679,900, filed May 11, 2005, the entire scope and content of which is hereby incorporated herein by reference.

TECHNICAL FIELD

The present invention relates generally to safety devices for weapons and, more particularly, to safety housings with a heavy-duty locking mechanism for preventing the use of a firearm by other than an authorized user of that firearm.

BACKGROUND OF THE INVENTION

Too many deaths and injuries are caused by unauthorized users gaining access to firearms. In many instances, it is the owner or authorized user of the weapon who is the victim of the shooting. For example, during a struggle between a police officer and a suspect, the suspect may gain control of the police officer's firearm and use it against the officer. Similarly, an intruder may gain control of a homeowner's firearm during a burglary and use the firearm against the homeowner. Children also sometimes gain access to firearms and unintentionally injure themselves or others. In order to prevent such tragic consequences, or to at least reduce their incidence, it is desirable to provide some type of safety device to prevent the use of a firearm by anyone other than an authorized user. However, it is also desirable that an authorized user not be prevented from quickly accessing and firing the firearm when necessary in an emergency.

For a number of reasons, many previously known safety devices have proven less than fully satisfactory in preventing unauthorized use of a firearm and/or they render the firearm too inaccessible for potential emergency use. For example, typical trigger locks are unwieldy to remove, and are not suited for use when a firearm must be available for immediate access. Many previously known security holsters do not positively lock the firearm in the holster, but instead require that the firearm be pivoted or otherwise manipulated according to a known sequence to enable removal. Such devices may not be completely effective in preventing removal and use of a weapon by an unauthorized user who knows or successfully guesses the manipulation sequence. Other devices require a user to wear a transmitter or bar code on the hand or wrist, which is recognized by the device to permit access to a firearm. Such devices have been found inconvenient as they require a user to wear a glove or transmitter at all times in order to have access to the firearm, and also are not completely effective in preventing removal and use of a weapon by an unauthorized user who obtains access to the transmitter or bar code. In addition, typical key-lock firearm cases and racks can be pried open without too much difficulty, and many children have been injured by gaining access to their parents' firearms because of this.

Accordingly, it can be seen that a need yet exists for a safety device for preventing unauthorized persons from accessing and using a firearm. A need further exists for such a device that nonetheless allows easy and fast access to the firearm by an authorized user. A need further exists for such a device that is impossible, or at least very difficult and time-consuming, for an unauthorized person to break into to access the firearm.

It is to the provision of a device meeting these and/or other needs that the present invention is primarily directed.

SUMMARY OF THE INVENTION

Generally described, the present invention provides a safety housing with a heavy-duty lock system for securing a firearm from unauthorized users. The housing includes a door assembly, a slide assembly, cooperating stop surfaces, and retainers. The door pivots or otherwise moves between a closed position and an open position for controlling access to the firearm. The slide assembly linearly slides or otherwise moves between a closed position and an open position, and includes slide-locking members. The stop surfaces engage to lock the door in the closed position when the slide assembly is locked in the closed position, and they disengage to release the door assembly from the closed position when the slide assembly is slid to the open position. And the retainers move between a locked position engaging the slide-locking members to lock the slide assembly in the closed position, and an unlocked position disengaged from the slide-locking members to release the slide assembly from the closed position.

In one aspect of the invention, the housing includes cooperating drive surfaces that engage to move the door to the open position when the slide assembly is moved to the open position. Also, the housing preferably includes a spring that forces the slide assembly towards the open position when the slide assembly is released from the locked closed position. So when the slide assembly is unlocked, the spring pushes the slide assembly upwards and the drive surfaces contact and interfere with each other to push the door open automatically without the need for the user to force the door open. But when the slide assembly is locked in place by the retainers, the stop surfaces contact and interfere with each other to prevent the door from being forced open by unauthorized persons.

The drive surfaces, the stop surfaces, the slide-locking members, and the retainers are internal to the housing and inaccessible to unauthorized users. The opening and closing of the door and the locking of the door in the closed position are accomplished by the stop and drive interference surfaces and by the cooperating retainers and slide-locking members. Because all of these locking components are internal and not accessible for tampering with, the housing is very heavy-duty and can withstand significant tampering and break-in efforts.

In another aspect of the invention, the housing includes a frame assembly and an enclosure for the major components of the housing, and the door assembly includes one or more lever arms. The frame assembly forms at least a first of the stop surfaces and the door lever arms form at least a second of the stop surfaces. Also, the frame assembly or the enclosure forms at least a first of the drive surfaces while the door lever arms form at least a second of the drive surfaces. The second stop surface may be a non-linear cam surface on the lever arm so that the slide assembly does not need to move as far to open the door. And the second stop surface and the second drive surface may be formed at opposite ends of a slot in the frame assembly.

In yet another aspect of the invention, the housing includes one or more support elements that support the firearm in the housing. For example, each support element may be a pin receivable in any of two aligned holes selected out of at least two series of aligned holes in the frame assembly, which provides for adjustable positioning of the support pins. This allows the housing to be used with a wide range of firearms. In addition, the support elements are preferably positionable so that the support elements and the door pinch or choke the narrowed part of the firearm between the trigger guard and the stock or grip to constrain the firearm in the housing.

In yet another aspect of the invention, the housing includes an access authentication device adapted to move the retainer from the locked position to the unlocked position upon authenticating an authorized user of the firearm. The access authentication device may be provided by a biometric authentication device such as a fingerprint scanner, an iris or retinal scanner, a hand scanner, a facial recognition scanner, a voice recognition sensor, or another means for biometric authentication. Also, the access authentication device may be provided by a conventional locking mechanism, such as a keylock, for use in applications where instant access to the firearm is not as critical.

The specific techniques and structures employed by the invention to improve over the drawbacks of the prior devices and accomplish the advantages described herein will become apparent from the following detailed description of the example embodiments of the invention and the appended drawings and claims.

DETAILED DESCRIPTION OF EXAMPLE EMBODIMENTS

Figure 1:
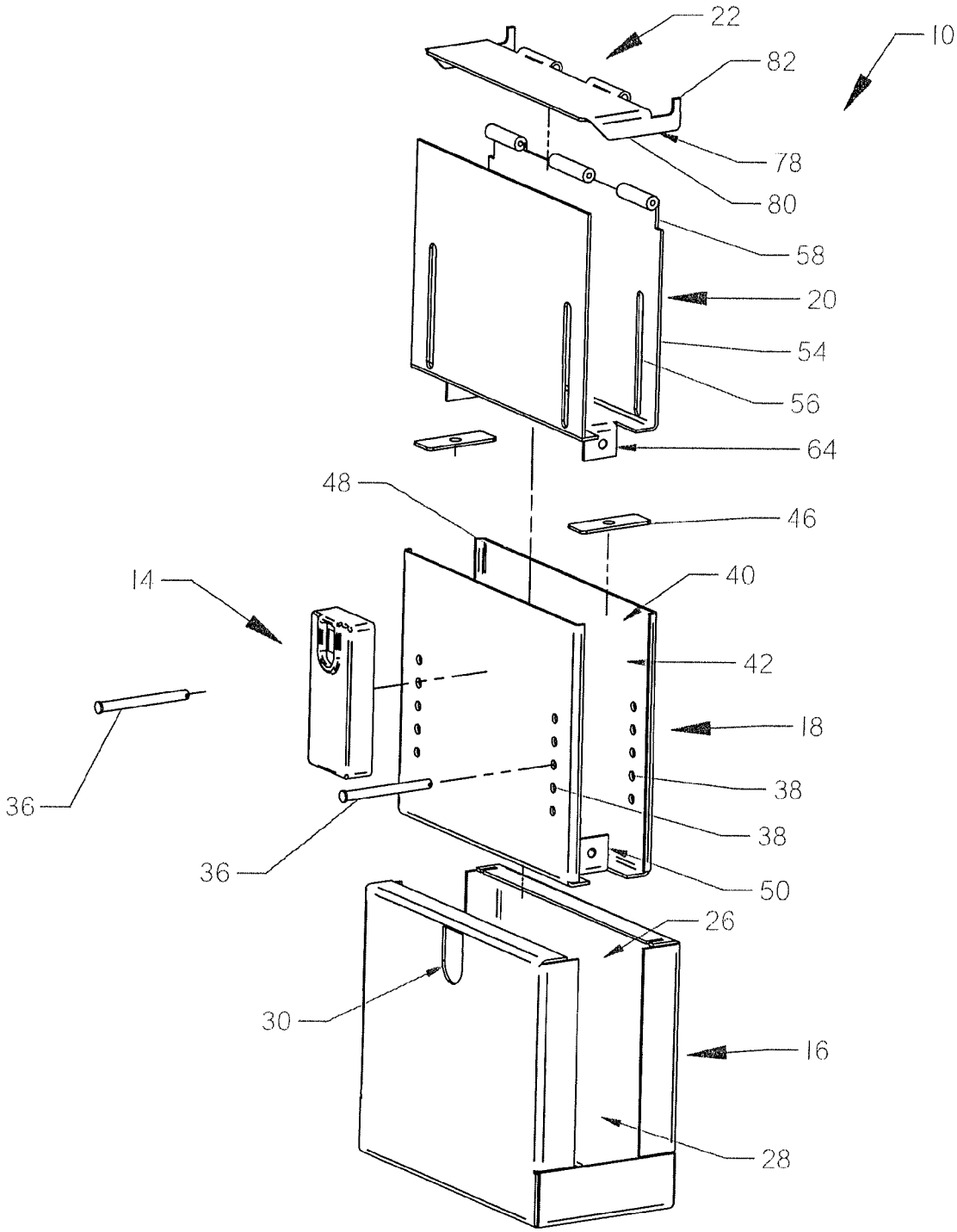
FIG. 1 is an exploded perspective view of a safety housing for preventing unauthorized access to a firearm according to a first example embodiment of the present invention, showing a biometric authentication device, an enclosure, a frame assembly, a slide assembly, and a door.
Figure 2:
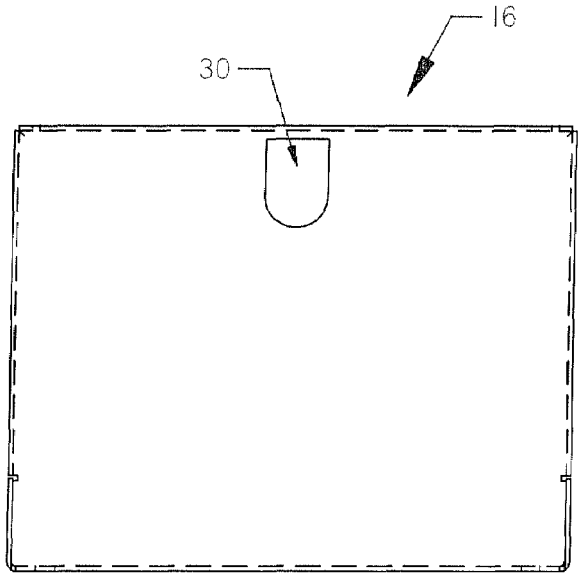
FIG. 2 is a front elevation view of the enclosure of FIG. 1.
Figure 3:
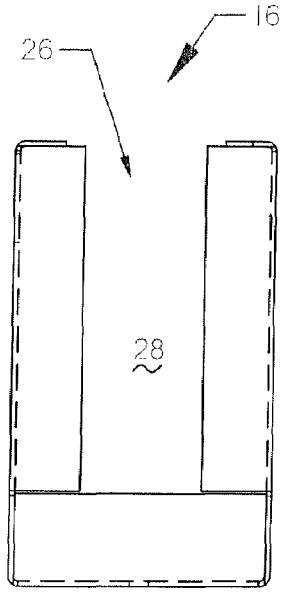
FIG. 3 is a right elevation view of the enclosure of FIG. 2.
Figure 4:
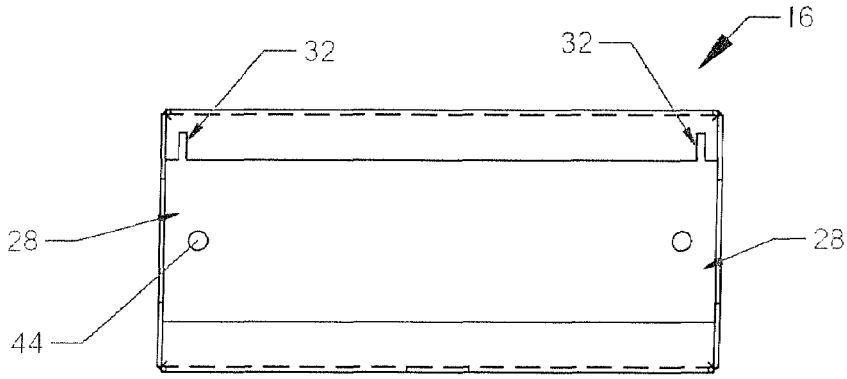
FIG. 4 is a plan view of the enclosure of FIG. 2.
Figure 5:
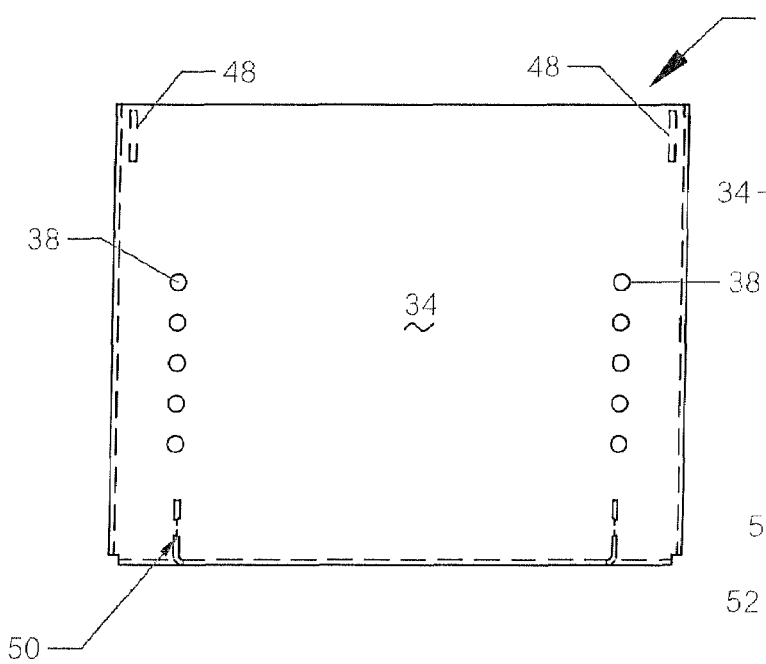
FIG. 5 is a front elevation view of the frame assembly of FIG. 1.
Figure 6:
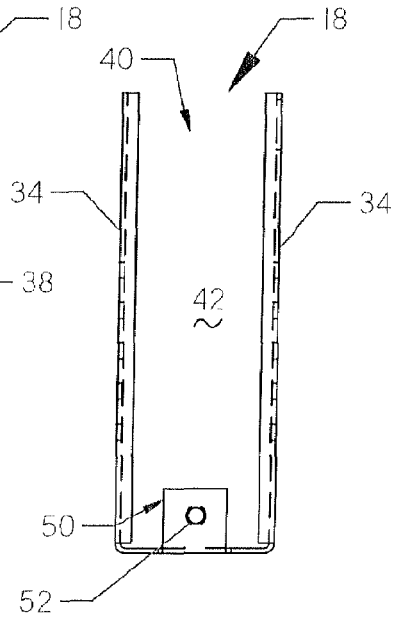
FIG. 6 is a right elevation view of the frame assembly of FIG. 5.
Figure 7:
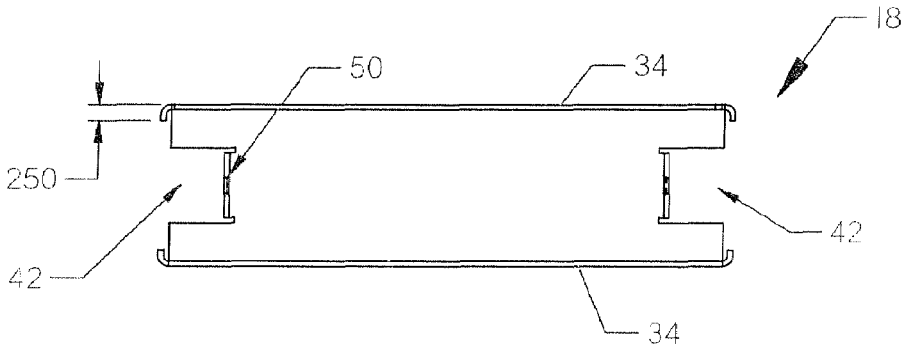
FIG. 7 is a plan view of the frame assembly of FIG. 5.
Figure 8:
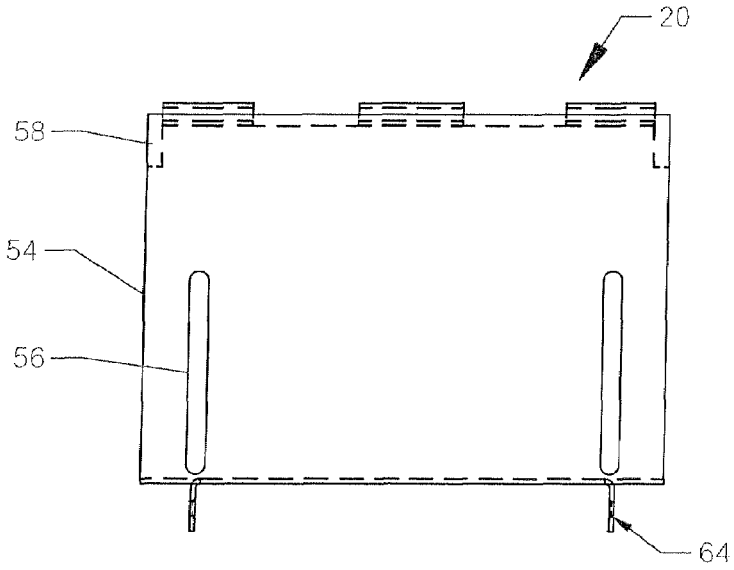
FIG. 8 is a front elevation view of the slide assembly of FIG. 1.
Figure 9:
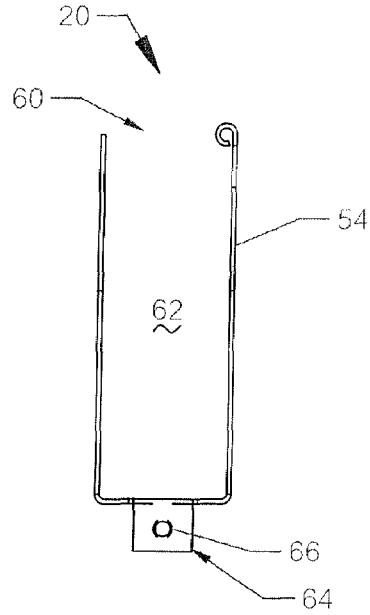
FIG. 9 is a right elevation view of the slide assembly of FIG. 8.
Figure 10:
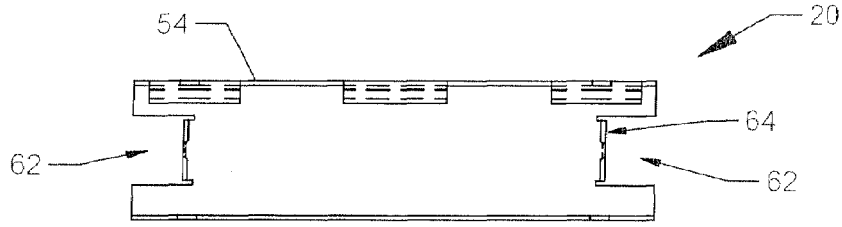
FIG. 10 is a plan view of the slide assembly of FIG. 8.
Figure 11:
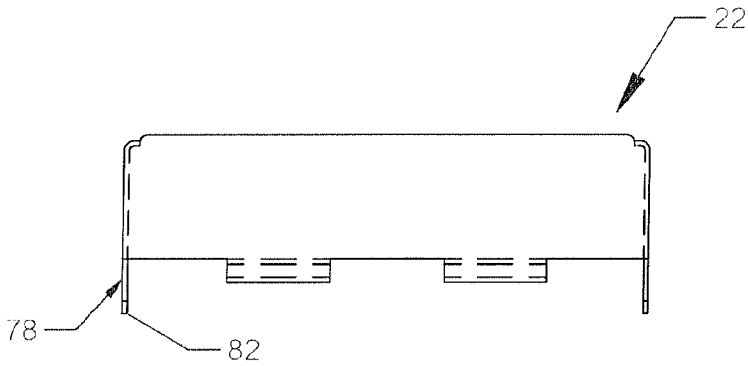
FIG. 11 is a plan view of the door of FIG. 1.
Figure 12:
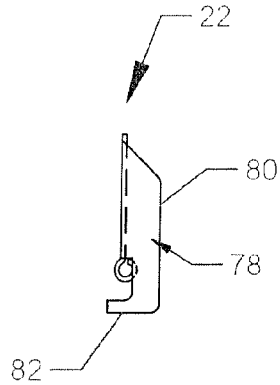
FIG. 12 is a right elevation view of the door of FIG. 11.
Figure 13:
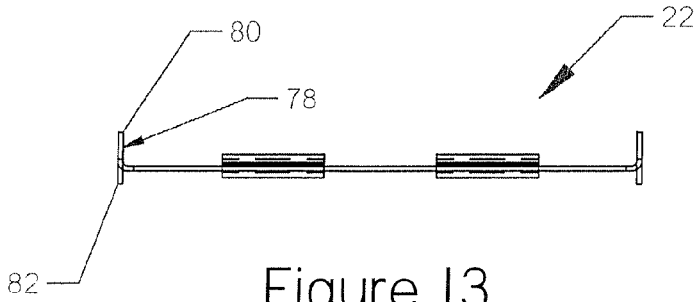
FIG. 13 is a rear elevation view of the door of FIG. 11.
Figure 14:
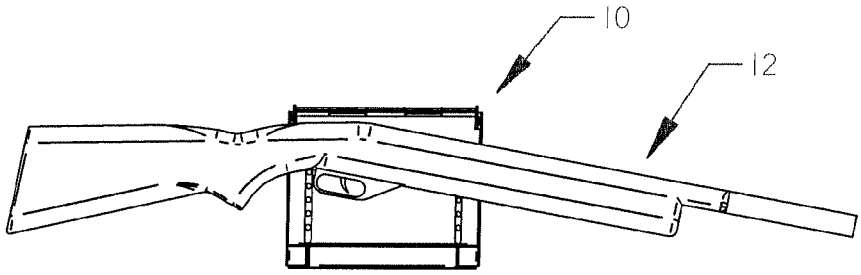
FIG. 14 is a front cross sectional view of the safety housing of FIG. 1 in a closed and locked position, showing a firearm secured from unauthorized access.

Referring now to the drawing figures, FIGS. 1-25 show a safety housing 10 according to a first example embodiment of the present invention. The housing 10 secures a firearm 12 from access by unauthorized persons. In the depicted embodiment, the housing 10 is adapted for use with a long gun such as a shotgun, rifle, muzzle-loaded rifle, automatic or semi-automatic rifle, or carbine. It will be understood by those skilled in the art that the housing 10 may be adapted for use with a handgun or other firearm having a narrowed section, typically between the trigger guard and the stock or grip.

The housing 10 may be mounted in place on its side or on its bottom to most any surface such as a wall or rack. Alternatively, the housing 10 may be mounted to or within a vehicle such as a law enforcement car, van, or motorcycle.

Referring to FIG. 1, the safety housing 10 includes an access authentication device 14, an enclosure assembly 16, a frame assembly 18, a slide assembly 20, and a door assembly 14. In a typical commercial embodiment, the access authentication device 14 is a biometric authentication device including a fingerprint scanner. In alternative embodiments, the access authentication device 14 includes a hand scanner, retinal scanner, facial recognition scanner, voice recognition sensor, or other means for biometric authentication. It will be understood that as-yet undeveloped biometric authentication technologies may be readily substituted in for the access authentication devices disclosed herein.

The biometric authentication device is operatively coupled to the slide assembly 20 so that, upon receipt of biometric information input from an authorized user and authentication of that biometric information, the slide assembly is released and movable. In an example embodiment, the biometric authentication device includes a fingerprint sensor model AES3550 marketed by AUTHENTEC. In another example embodiment, the biometric authentication device includes a BIOCONTROLLER fingerprint sensor marketed by SMART BIOMETRICS, INC. of Longwood, Fla. In yet another example embodiment, the biometric authentication device includes a FINGERCHIP thermal silicon chip fingerprint sensor, marketed by THOMSON-CSF, of Saint-Egrève, France, or the equivalent.

In addition, the biometric authentication device preferably includes a microprocessor-based programmable controller, such as for example, a MOTOROLA DSP56309 digital signal processor, an OXFORD MICRO DEVICES, INC. A236 video digital signal processor (DSP) chip, an OXFORD MICRO DEVICES, INC. A336FP fingerprint and image compression DSP chip, or the equivalent. The controller is powered by a power source, as described herein. In addition, the controller preferably is programmed and encrypted prior to assembly of the biometric authentication device, and preferably further comprises sufficient memory for storing input fingerprint or other biometric information of multiple authorized users.

In an example embodiment, the controller comprises a DSP chip and non-volatile memory, and is coupled to the fingerprint sensor or scanner. One or more signal amplifiers, transformers, additional programmable controllers, and/or other components may be provided, as desired for a particular component configuration, as can be readily determined by one of ordinary skill in the art. Information regarding the configuration of example forms of the controller and associated components may be obtained from the manufacturers of a particular component, and configuration and set-up parameters are within the level of skill in the art. See, for example: Data Sheet Summary, A236 Video Digital Signal Processor Chip, (Oxford Micro Devices, Inc.); and/or Application Notes for Fingerprint Processing Using the A336FP Fingerprint and Image Compression Digital Signal Processor DSP Chip, (Oxford Micro Devices, Inc.), each of which are incorporated herein by reference. For example, the controller can be provided by processor model MV1200 marketed by BIOSCRYPT of California.

The controller preferably stores input fingerprint or other biometric identification information of one or more authorized users in its memory and compares the identification information scanned into the fingerprint sensor with the stored identification information of authorized users to determine whether a person attempting to use the firearm is or is not an authorized user. If the scanned fingerprint or other biometric information matches that of an authorized user, the controller signals an actuator to unlock and release the slide assembly 20, which permits the firearm 12 to be withdrawn from the housing 10. If the scanned information does not match that of an authorized user, the controller sends no signal to the actuator, or signals the actuator to remain locked, and the slide assembly 20 remains locked in place so that the firearm 12 cannot be withdrawn from the housing 10. Details of the actuator and its operation to lock and unlock the slide assembly 20 and the firearm 12 are provided elsewhere herein, particularly in the discussion of FIG. 15.

In an alternative embodiment, the access authentication device 14 includes a sensor for authenticating a bar code on the user's hand or wrist (e.g., on a glove or strap), as is known in the art. In another alternative embodiment, the access authentication device 14 includes a receiver for authenticating a signal received from a transmitter worn on the user's hand or wrist (e.g., on a glove or strap), as is known in the art. In these embodiments, the access authentication device 14 typically includes a controller that signals the actuator to control the locking and unlocking of the slide assembly 20.

In still another alternative embodiments, the access authentication device 14 includes conventional mechanical locks, without the controller or actuator. For example, the access authentication device 14 can be provided by a conventional key-lock and linkage. When an authorized key is used in the lock, the linkage operates to release the slide assembly 20.

It will be understood that many other types of authentication devices 14 may be used in the present invention to selectively prevent and allow access to the firearm 12. While biometric authentication devices have been found to provide good results because with them the user can very quickly and easily access the firearm in the housing. But other authentication devices can be used with acceptable results in some applications. Accordingly, the scope of the present invention is not intended to be limited to any specific type of authentication device used.

Turning now to FIGS. 1-16, details will now be provided for the enclosure assembly 16, the frame assembly 18, the slide assembly 20, and the door assembly 14. In the depicted embodiment, these components are each made of metal and are each formed of a single sheet of steel bent into the final shapes shown. The sheets of the enclosure assembly 16, the frame assembly 18, and the slide assembly 20 nest within each other to provide three layers that unauthorized users would have to breach to gain access to the firearm 12 directly or to gain access to the locking components that secure the housing 10 closed. In other embodiments, other metallic or non-metallic materials, other manufacturing techniques such as fabrication and welding, and other numbers and shapes of component parts may be used. Thus, the term "assembly" as used herein is intended to include multiple parts or a single part. In addition, the dimensions shown in these figures are representative of a typical commercial embodiment. That is, these components can be made in other dimensions, and the dimensions shown are not intended to be limiting of the invention.

FIGS. 1-4 and 14-16 show details of the enclosure 16, which houses the access authentication device 14, the frame assembly 18, and the slide assembly 20. The enclosure 16 defines an access opening 26 and side or end openings 28 in communication with the access opening. The access opening 26 is for example at the top of the enclosure, the firearm 12 is replaceable through it, and when the firearm is secured in the housing 10 it extends through the side or end openings. In addition, the enclosure 16 defines a user input opening 30, and the fingerprint scanner of the access authentication device 14 is preferably mounted to the inside of the enclosure 16 and positioned so that the fingerprint scanner is accessed through the user input opening. Furthermore, the enclosure 16 preferably defines one or more tab openings 32 that are adjacent the access opening 26 and through which one or more tabs are received, as described herein.

FIGS. 1, 5-7, and 14-16 show details of the frame assembly 18, which supports the firearm 12 in the housing 10. The frame assembly 18 includes two (or another number of) opposing support elements 34 to which two (or another number of) frame elements 36 are mounted. In the depicted embodiment, for example, the support elements 36 are removable pins and the frame elements 34 are opposing panels that define aligned holes 38 that receive the support pins. Preferably, there are opposing vertical series of aligned holes 38 for receiving the support pins 36 in multiple vertical positions to provide adjustability for using the safety housing 10 with a wide range of firearms 12. In alternative embodiments, the support elements 36 are mounted to the frame elements 34 by multi-positionable brackets, vertical slots with lateral recesses defining support positions, or by other structural arrangements for providing adjustable or non-adjustable positions of the support elements.

Figure 15:
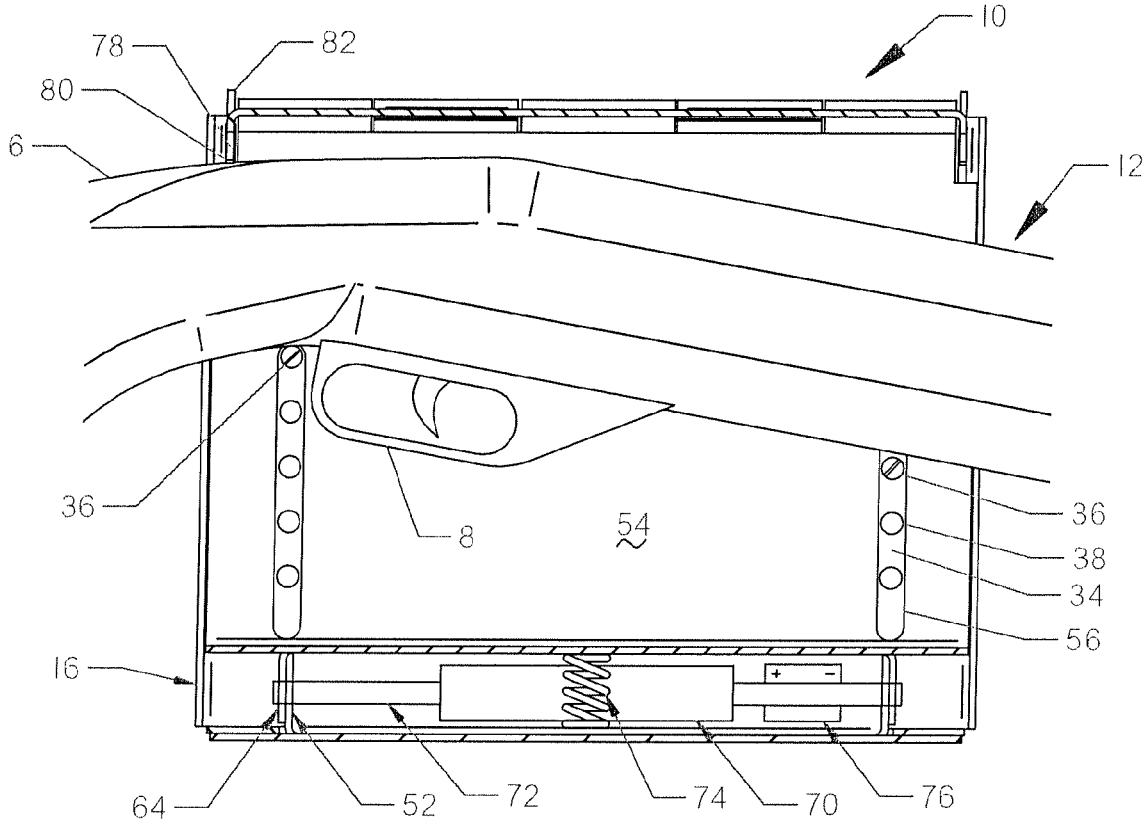
FIG. 15 is a front cross sectional view of the safety housing and a portion of the firearm of FIG. 14, showing details of the internal components of the housing.
Figure 16:
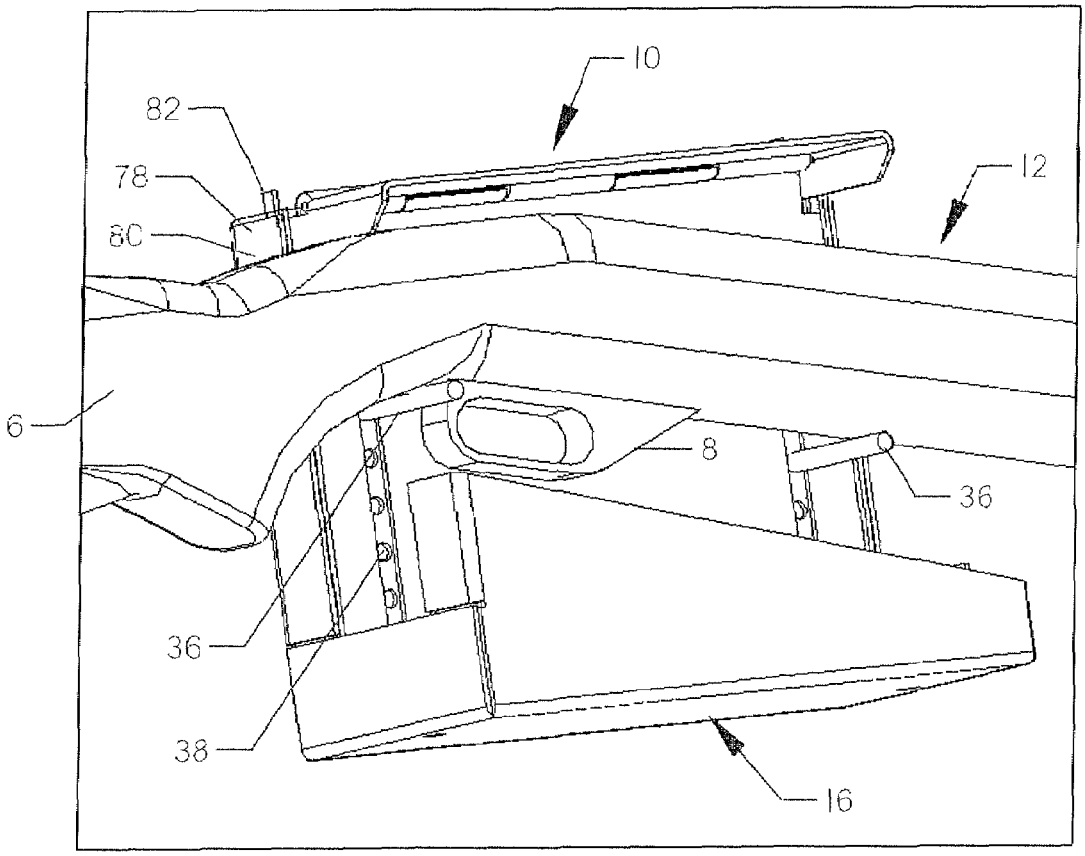
FIG. 16 is a perspective view of the safety housing and a portion of firearm of FIG. 14, with a portion of the front of the housing cut away to show the firearm secured from unauthorized access.
Figure 17:
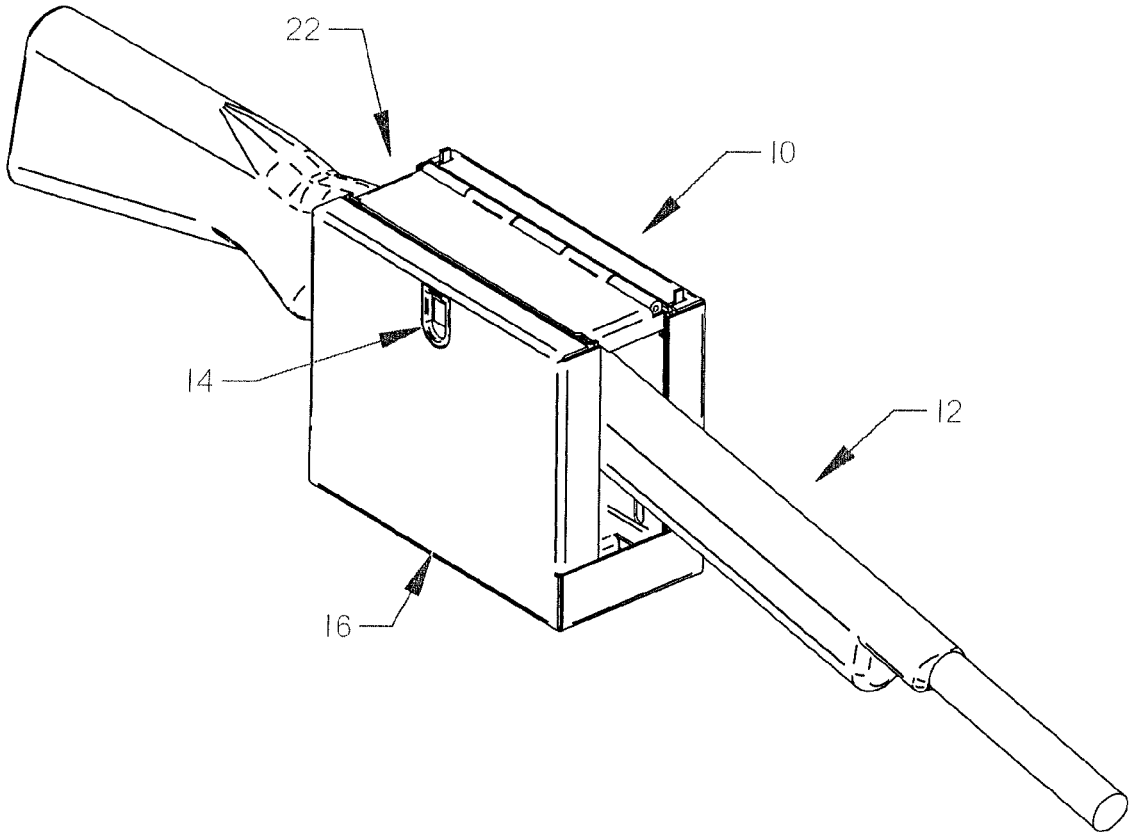
FIG. 17 is a perspective view of the safety housing and the firearm of FIG. 14, showing the housing in the locked closed position with the firearm secured from unauthorized access.
Figure 18:
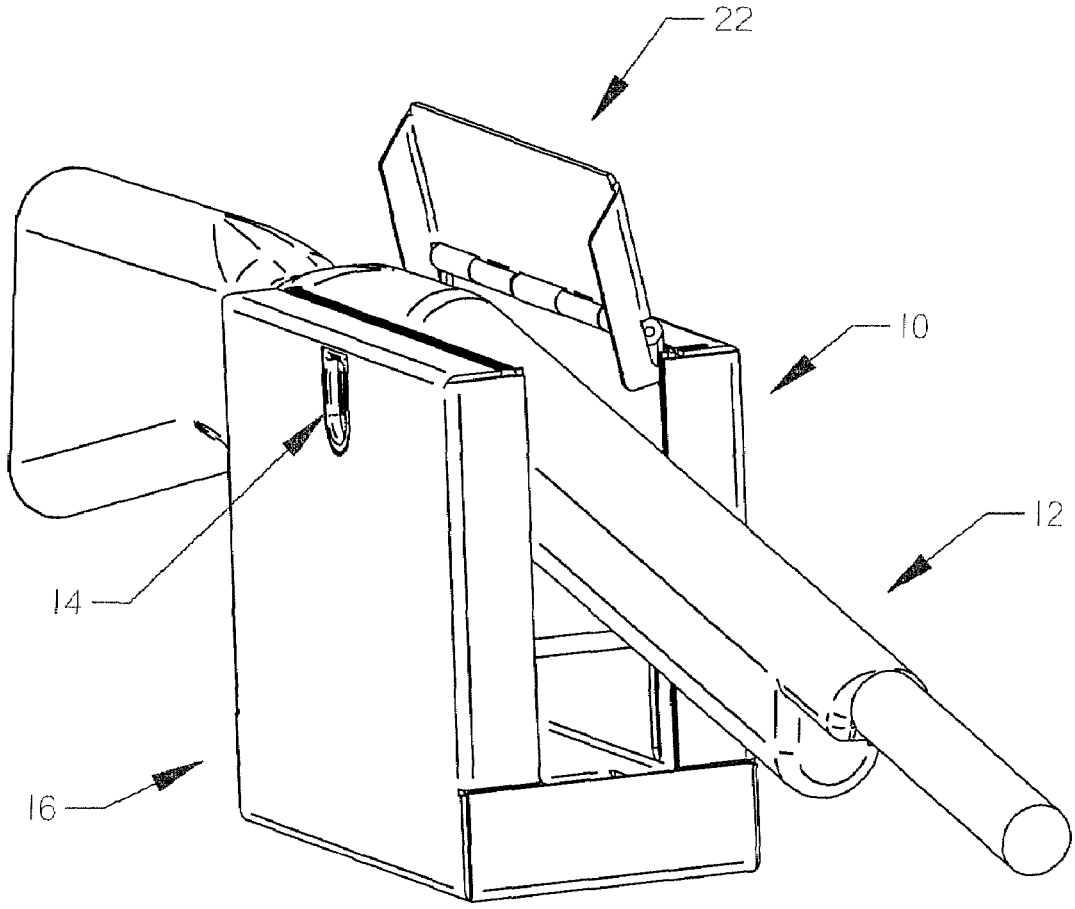
FIG. 18 is a perspective view of the safety housing and the firearm of FIG. 14, showing the housing in the open position with the firearm removable from the housing.

The firearm 12 is installed into the housing 10 so that one of the support elements 36 is positioned to support a narrowed section of the firearm 12 such as between the trigger guard 8 and the stock or grip 6, as shown in FIGS. 15 and 16. In that position, the narrowed section of the firearm 12 is constrained between that support element 36 (left side) and the door 22. The other one of the support elements 36 (right side) is positioned on the other side of the trigger guard 8 to balance the firearm 12. As depicted, that other support element 36 is too far below the door 22 to further constrain the firearm in the housing 10, but that other support element 36 may be positioned higher and/or shims or other structures may be provided below the door to further constrain the firearm.

In addition, the frame assembly 18 defines an access opening 40 and side or end openings 42 in communication with the access opening. Also, the frame assembly 18 may be secured to the enclosure 16 by conventional fasteners (e.g., bolts or screws) through mounting holes 44 in the enclosure and using mounting washers 46, or by other conventional fastening and/or mounting elements and techniques.

Furthermore, the frame assembly 18 includes two (or another number of) door-locking openings 48 and two (or another number of) support-locking members 50 with openings 52. Details of the door-locking openings 48 are provided elsewhere herein, particularly in the discussion of FIGS. 19-25.

FIGS. 1, 8-10, and 14-16 show details of the slide assembly 20, which includes at least one sliding element 54 that slides or otherwise moves relative to the frame assembly 18 to operate the door 22. In the depicted embodiment, for example, there are two opposing sliding elements 54 provided by connected panels positioned within the frame assembly 18. The opposing sliding panels 54 define support element openings 56 through which the support elements 36 extend to permit the slide assembly 20 to move relative to the frame assembly 18. The support element openings 56 may be in the form of slots, as depicted, or recesses or cutouts in the panels. In addition, the opposing sliding panels 54 define door-locking openings 58 that align with the door-locking openings 48 of the frame assembly 18. The door-locking openings 58 may be in the form of recesses or cutouts, as depicted, or slots in the panels. Alternatively, the sliding elements 54 may be provided by vertical bars or similar structures, in which case the support element openings 56 and the door-locking openings 58 are parts of larger openings defined by the bars.

In addition, the slide assembly 20 defines an access opening 60 and side or end openings 62 in communication with the access opening. With the slide assembly 20 nested within the frame assembly 18, which is nested within the enclosure 16, all of the access openings 26, 40, and 60, and all of the side or end openings 28, 42, and 62 are generally aligned for receiving the firearm 12 in the housing 10.

Furthermore, the slide assembly 20 includes two (or another number of) slide-locking members 64 with openings 66. The openings 66 of the slide-locking members 64 align with the openings 52 of the support-locking members 50 when the slide assembly 20 is in the locked closed position shown in FIG. 15. The safety housing 10 includes an actuator 70 that moves two (or another number of) retainers 72 through the aligned openings 52 and 66 of the support-locking members 50 and the slide-locking members 64 to secure the slide assembly 20 in the locked closed position. In the depicted embodiment, the retainers 72 are pins that fit through the aligned openings 52 and 66. In alternative embodiments, the slide-locking members 64 and the support-locking members 50 are provided by brackets, hooks, or other structures that are engaged by the retainers 72 to secure the slide assembly 20 from movement relative to the frame assembly 18. In other alternative embodiments, the locking functionality is provided by the slide-locking members 64 and the retainers 72, with the support-locking members 50 eliminated. In any case, the slide-locking members 64, the support-locking members 50, and the retainers 72 are internally located and inaccessible to those who might attempt to pry at or otherwise tamper with locking components.

Referring particularly to FIG. 15, the safety housing 10 further includes at least one spring element 74, for example a compression spring or elastic member, that biases the slide assembly 20 to slide or otherwise move from the locked position. When the access authentication device 14 identifies an authorized user, the actuator 70 removes the retainers 72 from locking engagement with the support-locking members 50 and the slide-locking members 64. This releases the slide assembly 20 to move from the locked position under the influence of the spring element 74. The movement of the slide assembly 20 relative to the frame assembly 18 causes the door 22 to open, thereby permitting the firearm 12 to be withdrawn from the housing 10.

In a typical commercial embodiment, once the slide assembly 20 is released and moves, the actuator 70 returns the retainers 72 to their locked position engaging the support-locking members 50. To return the firearm 12 to the housing 10 and lock it in, the firearm is placed in the frame assembly 18 and the door 22 and slide assembly 20 are pushed down. The slide-locking members 64 and the retainers 72 preferably have cooperating beveled leading edges to allow the slide-locking members 64 to force reengagement with the retainers 72.

The actuator 70 is provided by, for example, a servomotor or a solenoid. A rotary actuator may be used in conjunction with a T-bar on an axle, a rack-and-pinion gear assembly, or another conventional mechanism for converting the rotary output to a linear motion. The safety housing 10 preferably includes an AC plug, a step-down transformer, and a DC converter for providing regular power to the actuator 70 and (if needed) the access authentication device 14, plus a backup portable power supply 76 such as one or more batteries. In addition, an override security lock (not shown) is preferably included for releasing the firearm 12 from the housing 10 in the event the access authentication device 14 is damaged or otherwise inoperable. The actuators 70, the retainers 72, the spring element 74, and the override are preferably mounted in the enclosure 16, for example in the bottom of the enclosure.

FIGS. 1, 11-13, and 14-16 show details of the door 22, which is operated upon movement of the slide assembly 20 relative to the frame assembly 18. The door 22 includes two (or another number of) lever arms 78, contact surfaces 80, and tabs 82. The lever arms 78 engage other components of the housing 10 to open, close, and lock the door 22. The contact surfaces 80 (or at least one of them) contact the firearm 12 to constrain it within the housing 12. And the tabs 82 extend through the tab openings 32 of the enclosure 16 to produce a supplemental locking effect, making it more difficult and/or time-consuming, if even possible, to pry open the housing 10 and access the firearm 12. In the depicted embodiment, the lever arms 78 are provided by downwardly turned panels that are at the ends of a door panel, the contact surfaces 80 are defined by lower edges of the lever arms, and the tabs 82 extend upwardly from the ends of the lever arms opposite the contact surfaces.

In addition, the door 22 is hingedly coupled to the slide assembly 20. The door 22 pivots from the closed position shown in FIGS. 14-17 to the open position shown in FIG. 18. In the closed position, the firearm 12 is secured in the housing 10 and in the open position the firearm can be withdrawn through the aligned access openings of the enclosure, the frame assembly, and the slide assembly. In alternative embodiments, the door 22 is movably coupled to the frame assembly 18 or another part of the housing 10, and the housing is adapted so that the lever arms 78 engage other components to open, close, and lock the door upon movement of the slide assembly 20 relative to the frame assembly 18.

Figure 19:
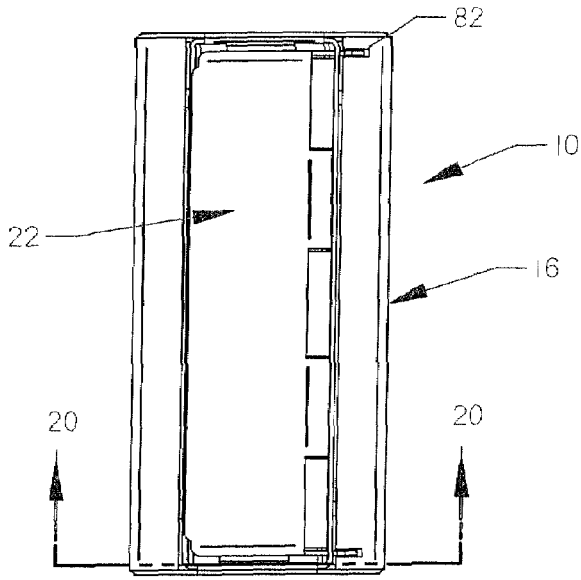
FIG. 19 is a right elevation view of the safety housing of FIG. 1 with the components assembled.
Figure 20:
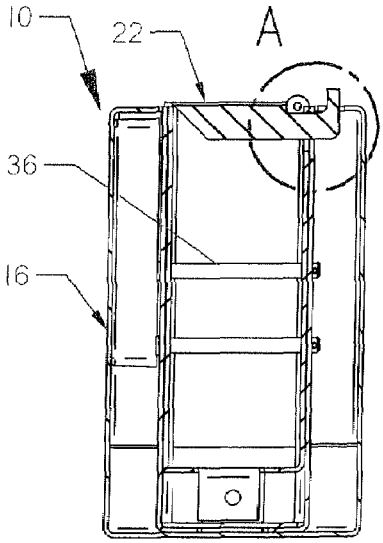
FIG. 20 is a cross section view of the safety housing taken at line 20-20 of FIG. 19, showing the door in a locked closed position.
Figure 21:
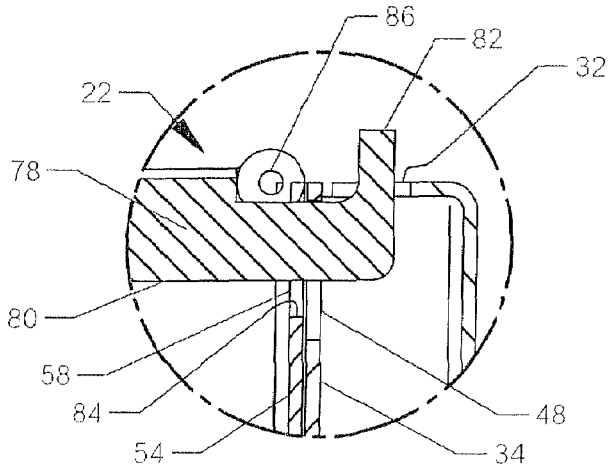
FIG. 21 is a detail view of a portion of the safety housing of FIG. 20.

FIGS. 19-25 show how the lever arms 78 of the door 22 cooperate with the slide assembly 20 and the frame assembly 18 to open, close, and lock the door. In FIGS. 19-21, the housing 10 is in the locked closed position, with the door 22 locked from pivoting about its pivot point 86. The housing 10 includes two (or another number of) stop surfaces 84 that constrain the door 22 from pivoting open. In the depicted embodiment, the stop surfaces 84 are at the lower ends of the door-locking openings 58 defined by the sliding panels 54 of the slide assembly 20. The stop surfaces 84 are offset from the pivot point 86 of the door 22. As best shown in FIG. 21, if a person attempted to pry open the door 22 by forcing up the free side of the door (opposite the pivot/hinge), the door would pivot open slightly but then stop surfaces at the bottom edges of the lever arms 78 would come into contact with the stop surfaces 84, thereby blocking the door from pivotal movement sufficient to access the firearm 12.

Figure 22:
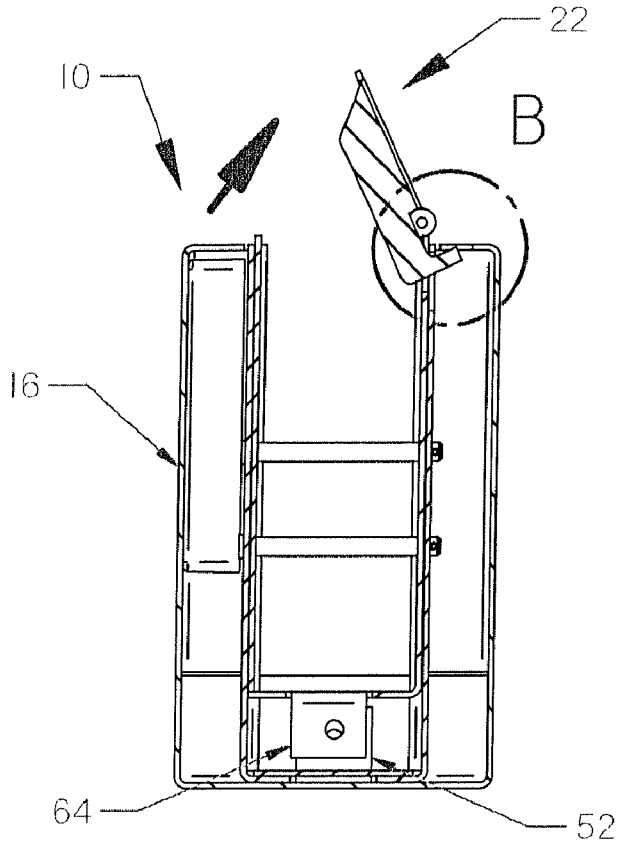
FIG. 22 is a cross sectional view of the safety housing of FIG. 20, showing the door moving towards an open position.
Figure 23:
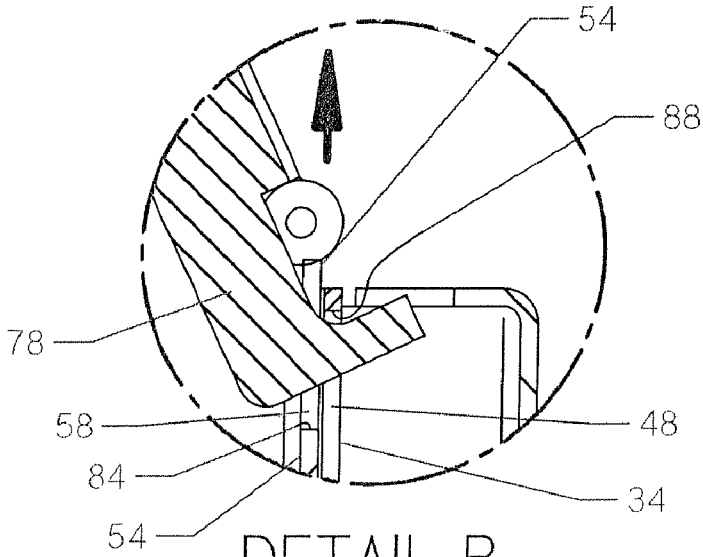
FIG. 23 is a detail view of a portion of the safety housing of FIG. 22.

In FIGS. 22 and 23, an authorized user has been identified, the slide-locking members 64 have been released from the retainers 72, and the slide assembly 20 has been moved upwards from the closed position under the charge of the spring element 74. Because the slide assembly 20 and the door 22 have moved upwards (as indicated by the vertical directional arrows), and the enclosure 16 and the frame assembly 18 have not, the stop surfaces of the lever arms 78 now can clear the stop surfaces 84, so the door is now unlocked and can be pivoted open.

In addition, the housing 10 includes two (or another number of) drive surfaces 88 that contact two (or another number of) drive surfaces on the lever arms 78 and force the unlocked door 22 towards the open position as the slide assembly 20 continues moving upwards. In the depicted embodiment, the drive surfaces 88 are at the upper ends of the door-locking openings 48 defined by the frame elements 34 of the frame assembly 18. As best shown in FIG. 23, because the slide assembly 20 has moved upwards, and the frame assembly 18 has not, the drive surfaces on the lever arms 78 of the door 22 have come into contact with and been blocked from upward movement by the drive surfaces 88. This induces the door 22 to rotate about its pivot point 86 from the closed position towards the open position. Preferably, the lever arms 78 define curved cam drive surfaces along which the lever arm drive surfaces 88 ride to force open the door 22 with minimal vertical movement of the slide assembly 18.

Figure 24:
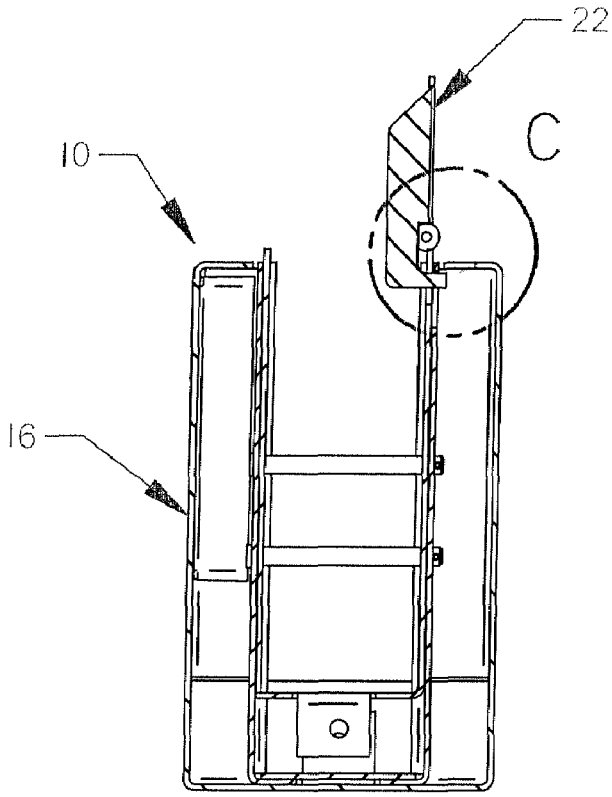
FIG. 24 is a cross sectional view of the safety housing of FIG. 20, showing the door in the open position.
Figure 25:
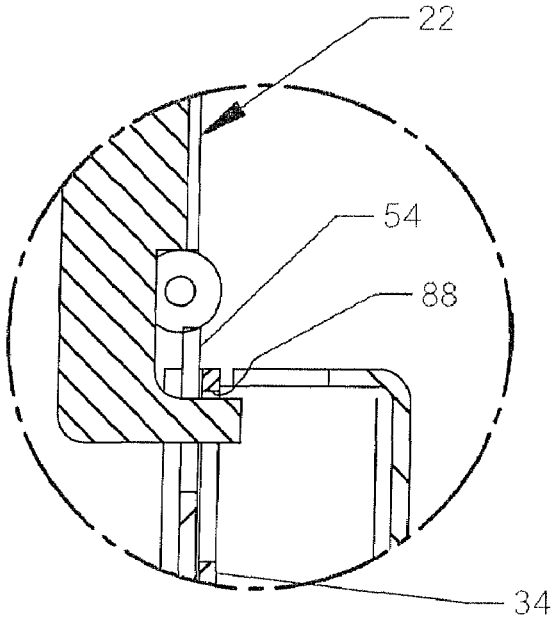
FIG. 25 is a detail view of a portion of the safety housing of FIG. 24.

In FIGS. 24 and 25, the housing 10 is in the open position, with the drive surfaces 88 having driven the door 22 to its fully open position. The authorized user can now withdraw the firearm 12 from the housing 10 by lifting the firearm straight up. The housing 10 can left open or it can be manually closed by pushing the door shut, if so desired.

To return the firearm 12 to the housing 10 for safety, the user operates the access authentication device 14 if the housing was closed, then lowers the firearm onto the support elements 36 of the frame assembly 18. The user then pushes the door 22 towards the closed position, causing the contact between the lever arms 78 the drive surfaces 88 to force the slide assembly 20 down. The user pushes the door 22 closed until the slide-locking members 64 re-engage the retainers 72 to lock the slide assembly in place again.

Before use, the user sets up the housing 10 for the particular firearm 12 they intend to secure. This involves placing the firearm inside the frame assembly 18 and the slide assembly 20, then turning these components upside down. The user then places the support elements 36 in the aligned holes 38 to most closely pinch or choke the narrowed part of the firearm 12 between the trigger guard 8 and the stock 6. For some firearms, the supports elements 36 will be at the same vertical position (thus defining a horizontal line), and for other firearms the supports elements will be at different vertical positions. The user then returns these components to their normal orientation, removes the firearm, and secures the frame assembly 18 and the slide assembly 20 inside the enclosure 16. The assembled and adjusted unit can now be mounted in a desired location and is ready for use.

Figure 26:
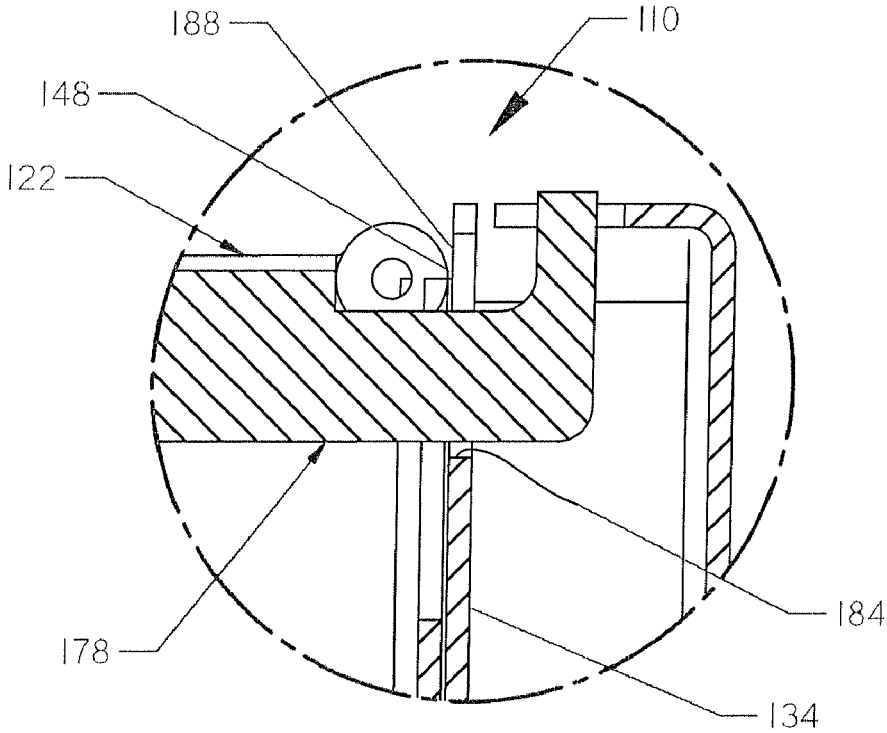
FIG. 26 is a detail view of a portion of a safety housing for preventing unauthorized access to a firearm according to a second example embodiment of the present invention, showing a modified arrangement for locking the housing.

FIG. 26 shows a modified locking arrangement of a safety housing 110 according to a second example embodiment of the present invention. In this embodiment, the housing 110 is very similar to that of the first embodiment. But the stop surfaces 184 are at the lower ends of the door-locking openings 148 defined by the frame elements 134 of the frame assembly. As can be seen in the figure, this embodiment eliminates any play in the door of the first embodiment, so the door 122 is locked securely closed by the contact between stop surfaces of the lever arms 178 and the stop surfaces 184. But the slide assembly must rise further for the drive surface 188 to engage and force the lever arms 178, and thus the door 122, to the open position.

Figure 27:
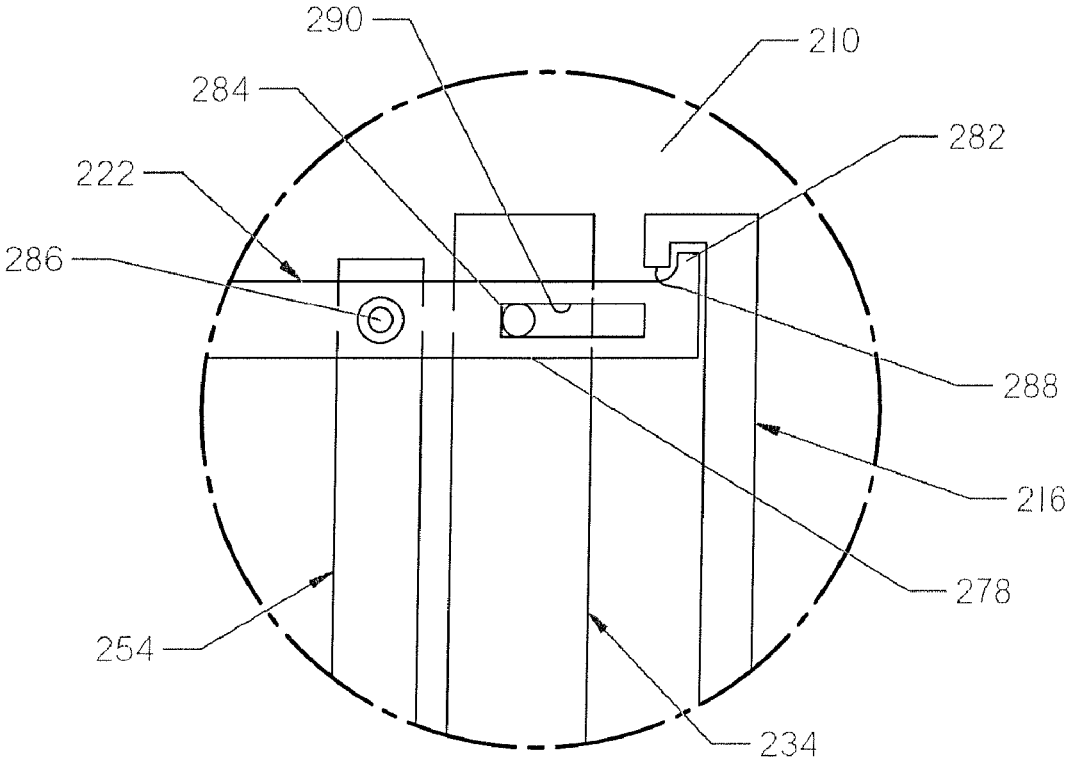
FIG. 27 is a detail view of a portion of a safety housing for preventing unauthorized access to a firearm according to a third example embodiment of the present invention, showing another modified arrangement for locking the housing.

FIG. 27 shows a modified locking arrangement of a safety housing 210 according to a third example embodiment of the present invention. In this embodiment, the housing 210 is similar to that of the first embodiment. But the stop surfaces 284 are defined by pins that extend through slots 290 defined by stop surfaces in the lever arms 278. With the sliding element 254 locked to the frame element 234, and the stop surfaces 284 offset from the pivot point 286, the door 222 is locked in the closed position. When the sliding element 254 is released and raised by the spring element, the pins that define the stop surfaces 284 travel along the slots 290 in the lever arms, allowing the door 222 to open. In addition, the drive surfaces 288 are defined by the enclosure 216 and engage drive surfaces on the tabs 282 on the lever arms 278 to open and close the door 222 in response to the slide assembly moving up and down relative to the frame assembly.

Figure 28:
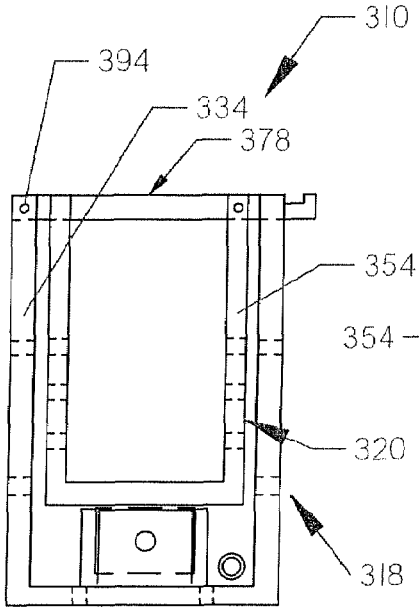
FIG. 28 is a right elevation view of a safety housing for preventing unauthorized access to a firearm according to a fourth example embodiment of the present invention, showing a modified slide assembly.
Figure 29:
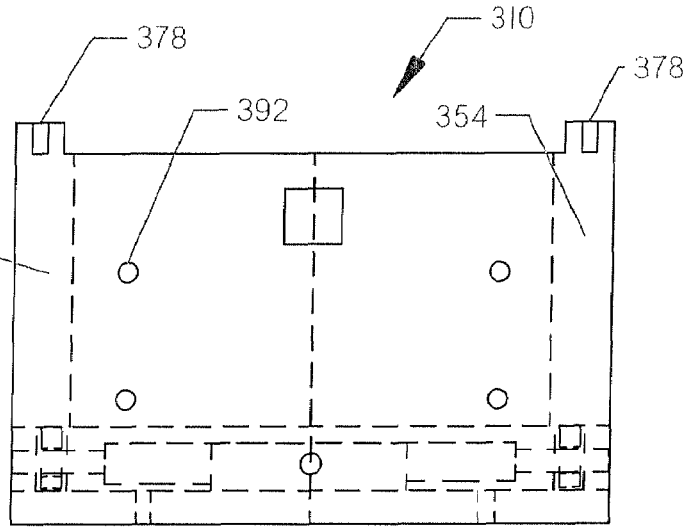
FIG. 29 is a front elevation view of the safety housing of FIG. 28.

FIGS. 28 and 29 show the frame assembly 318, the slide assembly 320, and the door 322 of a housing 310 according to a fourth example embodiment of the present invention. In this embodiment, the housing 310 is very similar to that of the first embodiment. But the slide assembly 320 has two longitudinally spaced apart sets of opposing sliding elements 354, that is, instead of a continuous U-shaped panel there are two longitudinally spaced apart U-shaped bars that serve as the support elements for the firearm (referred to as "cradles" in early designs). In addition, the door includes the two longitudinally spaced apart lever arms 378 (referred to as "locking bars" in early designs) of the first embodiment, but not the panel extending between them. Thus, this housing 310 is more open to tampering with, but it is also lighter and requires less material to construct.

In addition, this housing 310 includes mounting holes 392 for mounting the housing 310 in a fixed location. Furthermore, this housing 310 includes alignable lock holes 394 in the lever arms 378 and the frame elements 334 for use with a conventional lock (e.g., a padlock) to further secure the firearm. The use of these lock holes 394 to conventionally lock the housing 310 could be useful when the authorized user is away for long periods of time.

In an alternative embodiment, the housing does not include the spring element. In this case, there is no spring element to force the slide assembly upwards, so the door is not moved from the closed position to the open position upon release of the slide assembly. Instead, the user manually lifts up on the firearm, which manually forces the door up and open.

In another alternative embodiment, the housing does not include the separate enclosure. In this case, the frame assembly functions as the outer protective cover for the internal locking components, the access authentication device, etc. The stop surfaces and the drive surfaces are defined on brackets or other structures extending inward from the frame assembly. In this way, the lever arms do not extend all the way through the frame assembly, but instead they remain internal and thus inaccessible to unauthorized users.

In yet another alternative embodiment, the support elements for the firearm are part of the slide assembly instead of the frame assembly. In this case, the support elements are mounted to the slide elements instead of to the frame elements, so the firearm moves with the slide assembly. So the frame assembly may be scaled down in size and material, if desired, as long as the interference surfaces for opening/closing and locking the door remain.

In still another alternative embodiment, the door is pivotally coupled to the frame assembly, the enclosure, or another non-moving component of the housing, instead of being pivotally coupled to the slide assembly. In this case, the stop surfaces, the drive surfaces, or other interference surfaces for opening/closing and locking the door are defined by the slide assembly instead of the frame assembly.

In a further alternative embodiment, the housing is adapted for use with a handgun. In this case, the handgun is completely contained within the housing, thus there are no end or side openings through which the handgun extends. So the support elements and door need not be arranged to choke or pinch the narrowed part of the handgun. The internal interference surfaces of the frame, slide, and door assemblies secure the door closed and locked, and this provides the needed security. Of course, the housing of the above-described example embodiments can be used for securing handguns extending at least partially out of the housing through the end or side openings and that are choked or pinched at their narrowed part.

Accordingly, it can be seen that the present invention provides a number of advantages over known firearm locking devices. Advantageously, the present invention provides a firearm housing that is extremely difficult if not impossible to break in to. In particular, all of the locking structures are internal to the housing and not accessible to persons attempting to pry the housing open. In addition, the housing is adjustable for use with a wide range of long guns or other firearms. Furthermore, the housing may be provided with a biometric authentication device for quick and easily access to the firearm by authorized users. Moreover, unauthorized users are not allowed any access at all to the firearm.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in example forms, it will be apparent to those skilled in the art that many modifications, additions, and deletions can be made therein without departing from the spirit and scope of the invention as defined by the following claims.

What is claimed is:

1. A housing for securing a firearm, comprising:

a) a door assembly that moves about a pivot axis and between a closed position preventing the firearm from being withdrawn from the housing and an open position permitting the firearm to be withdrawn from the housing;

b) a slide assembly that moves between a closed position and an open position, wherein the slide assembly includes at least one slide-locking member, wherein the door assembly is pivotally coupled to the slide assembly at the pivot axis;

c) at least one set of first and second cooperating drive surfaces that engage to move the door assembly to the open position in response to the slide assembly moving to the open position, wherein the second drive surface is defined by the door assembly and the first drive surface is fixed and defined by another part of the housing, wherein as the slide assembly moves from the closed position toward the open position the second drive surface is moved into contact with the first drive surface at a location offset from the pivot axis, and wherein as the slide assembly moves farther toward the open position and the first drive surface remains fixed then the resulting lever force of the first drive surface on the second drive surface pivots the door assembly to the open position; and d) at least one retainer that moves between a locked position engaging the slide-locking member to lock the slide assembly in the closed position and an unlocked position disengaged from the slide-locking member to release the slide assembly from the closed position.

2. The housing of claim 1, further comprising at least one set of first and second cooperating stop surfaces that engage to lock the door in the closed position when the slide assembly is locked in the closed position and that do not engage so that the door assembly is free to move from the closed position when the slide assembly is moved to the open position, wherein the second stop surface is defined by the lever arm of the door assembly and the first stop surface is fixed and defined by another part of the housing.

3. The housing of claim 2, further comprising a frame assembly that defines the first stop surface.

4. The housing of claim 3, wherein the first stop surface is defined by an opening in the frame assembly or by a pin extending from the frame assembly.

5. The housing of claim 3, wherein the door assembly includes at least one lever arm that defines the second stop surface.

6. The housing of claim 2, wherein the door assembly includes at least one lever arm that defines the second stop surface.

7. The housing of claim 6, wherein the second stop surface is defined by a bottom edge of the lever arm or by an opening in the lever arm.

8. The housing of claim 2, wherein the drive surfaces, the stop surfaces, the slide-locking member, and the retainer are internal to the housing and inaccessible to unauthorized users.

9. The housing of claim 1, further comprising a spring element that moves the slide assembly towards the open position upon release of the slide assembly from the locked closed position.

10. The housing of claim 1, further comprising a frame assembly or an enclosure for the frame assembly that defines the first drive surface.

11. The housing of claim 1, wherein the door assembly includes at least one lever arm that defines the second drive surface.

12. The housing of claim 11, wherein the second drive surface is a cam surface defined by the lever arm.

13. The housing of claim 1, further comprising at least one support element that supports the firearm in the housing, wherein the support element is positionable for cooperating with the door to pinch or choke a narrowed section of the firearm to constrain of the firearm when the door is in the closed position and the slide assembly is in the locked closed position.

14. The housing of claim 13, wherein the support element is adjustably positionable for use with other firearms.

15. The housing of claim 1, further comprising means for authenticating an authorized user of the firearm based on biometric information and moving the retainer from the locked position to the unlocked position upon the user authentication.

16. A housing for securing a firearm, comprising:

a) a door assembly including a door and at least one lever arm, wherein the door pivots about a pivot axis and between a closed position preventing the firearm from being withdrawn from the housing and an open position permitting the firearm to be withdrawn from the housing;

b) a fixed frame assembly including at least one support element for supporting the firearm in the housing;

c) a slide assembly that slides relative to the frame assembly between a closed position and an open position, wherein the slide assembly includes at least one slide-locking member, wherein the door is pivotally coupled to the slide assembly at the pivot axis;

d) at least one set of first and second cooperating stop surfaces with the second stop surface defined by the lever arm of the door assembly and with the first stop surface defined by the frame assembly, wherein the stop surfaces engage to lock the door in the closed position when the slide assembly is locked in the closed position and disengage to release the door from the closed position when the slide assembly is moved to the open position;

e) at least one set of first and second cooperating drive surfaces that engage to move the door to the open position in response to the slide assembly moving to the open position, wherein the second drive surface is defined by the lever arm of the door assembly and the first drive surface is defined by the fixed frame assembly, wherein as the slide assembly moves from the closed position toward the open position the second drive surface is moved into contact with the first drive surface at a location offset from the pivot axis, and wherein as the slide assembly moves farther toward the open position and the first drive surface remains fixed then the resulting lever force of the first drive surface on the second drive surface pivots the door to the open position;

f) at least one retainer that moves between a locked position engaging the slide-locking member to lock the slide assembly in the closed position and an unlocked position disengaged from the slide-locking member to release the slide assembly from the closed position;

g) an access authentication device adapted to move the retainer from the locked position to the unlocked position upon authenticating an authorized user of the firearm; and h) a spring element that moves the slide assembly towards the open position upon release of the slide assembly from the locked closed position.

17. The housing of claim 16, wherein the access authentication device comprises a means for authenticating the authorized user based on biometric information.

18. The housing of claim 16, further comprising an enclosure for the frame assembly, the slide assembly, and the retainer, wherein drive surfaces, the stop surfaces, the slide-locking member, and the retainer are internal to the housing and inaccessible to unauthorized users.

* * * * *